US008365908B2

(12) United States Patent
Shiao

(10) Patent No.: US 8,365,908 B2
(45) Date of Patent: Feb. 5, 2013

(54) GOLF BAG

(76) Inventor: Kun-Lin Shiao, Yangmei Chen (TW)

( * ) Notice: Subject to any disclaimer, the term of this patent is extended or adjusted under 35 U.S.C. 154(b) by 428 days.

(21) Appl. No.: 12/823,233

(22) Filed: Jun. 25, 2010

(65) Prior Publication Data

US 2011/0315578 A1 Dec. 29, 2011

(51) Int. Cl.
*A63B 55/00* (2006.01)

(52) U.S. Cl. ..... 206/315.7; 248/96

(58) Field of Classification Search ..... 206/315.7; 248/96

See application file for complete search history.

(56) References Cited

U.S. PATENT DOCUMENTS 1,715,668 A * 6/1929 Mooney ..... 224/615
5,474,176 A * 12/1995 Schenkkan ..... 206/315.7
6,652,045 B1 * 11/2003 Jungkind ..... 206/315.7
7,494,009 B2 * 2/2009 Shiao ..... 206/315.7
7,617,931 B2 * 11/2009 Shiao ..... 206/315.7

* cited by examiner

*Primary Examiner* — Tri Mai
(74) *Attorney, Agent, or Firm* — C. G. Mersereau; Nikolai & Mersereau, P.A.

(57) ABSTRACT

A golf bag has a cord, a bottom frame and a top frame. The bottom frame has a cover and a bottom cuff received therein. The bottom cuff is pivotally mounted to the cover and has a bevel surface, a lever holder and a lever received in the lever holder and tied to the cord. The top frame has a cord guide for guiding and branching the cord and two leg holders tied to two branches of the cord and abut against the cord guide. When the golf bag is tilted, the bevel surface rests on the cover, the cord is dragged down to pull and extend out the two leg holders to stand on the ground. As the cover stay intact when the bottom cuff tilts, the golf bag can stably stand and requires a simplified cord linking design.

20 Claims, 10 Drawing Sheets

GOLF BAG

BACKGROUND OF THE INVENTION

1. Field of the Invention

The present invention is related to a golf bag, and more particularly to a golf bag that can be stably stood obliquely and has a simplified cord linking design.

2. Description of the Related Art

In consideration of firmly laying golf bags in all terrain of golf courses and easily accessing clubs inside the golf bags, obliquely laying golf bags on the ground with the support of a bipod can be an ideal way.

With reference to FIG. 9, a conventional golf bag with an integral bipod stand has a bag body 91, two legs 92, a pivot bracket 93, two activating rods 94 and multiple guide brackets 95. The bag body 91 has an open top, a bottom and a sidewall. The legs 92 are attached pivotally on the sidewall of the bag body 91 close to the top, and each leg 92 has a proximal end. The pivot bracket 93 is mounted pivotally on the bottom of the bag body 91, has a flat bottom and contacts the ground when the golf bag 91 stands on the ground. The activating rods 94 are connected pivotally to the pivot bracket 93, and each activating rod 94 has a distal end. The distal ends of the activating rods 94 are pivotally attached respectively to the legs 92 near the proximal ends of the legs 92. The guides 95 are mounted on the sidewall, and each guide 95 has two through holes through which the activating rods 94 respectively extend. Inclining the bag body 91 relative to the pivot bracket 93 causes the activating rods 92 to pivot the legs 92 away from the bag body 91 so that the golf bag can stand obliquely and stably on the ground.

However, the activating rods 94 are exposed and are easily damaged or broken in the course of normal uses, and dust, dirt corrosion or other debris easily accumulates in the through holes in the guides 95 and restricts the movement of the activating rods 94 through the guides 95. Besides, the exposed activating rods 94 are not aesthetically appealing and the golf bag obliquely standing on the ground with an edge of the bottom facing the legs 92 and a part of the pivot bracket 93 is not stably enough.

According to U.S. Pat. No. 7,494,009,, entitled to "Golf Bag Frame With A Leg Assembly", the golf bag can fulfill the purpose of obliquely standing on the ground with a base and two legs pulled to extend out by a cord extending from the distal end of two activating lever and a foot of the base. The drawback of the '009, Patent is that such a golf bag requires more effort in designing the top frame to allow the cord to penetrate through a passage defined through the top frame.

With reference to FIG. 10, another conventional golf bag has a bag body 7, a pivoting base 8 and a rear post 6. The bag body 7 has a bottom and a front portion. The rear post 6 is mounted on the bottom of the bag body 7 to support the weight of bag body 7. The pivoting base 8 is mounted on the bottom of the bag body 7 and has a bottom 81, a sidewall 82, two pivot balls 83 and a mounting bracket 84. The rear post 6 is mounted on the rear of the bottom 81 of the pivoting base 8 to support the weight of the bag body 7 and the weight of all clubs in the bag body 7.

The sidewall 82 is formed on and protrudes upward from the bottom 81. The pivot balls 83 are mounted on the sidewall 82. The mounting bracket 84 is mounted on the sidewall 82 at a position away from the pivot balls 83. The pivot bracket 84 is mounted pivotally on the sidewall 82. With the pivoting base 8, the golf bag can obliquely stand on the ground more firmly than the golf bag with an integral bipod stand as shown in FIG. 9. However, the issue that the exposed activating rods are easily damaged or not aesthetically appealing still exists. Furthermore, due to the tilting angle of the golf bag, the weight of the golf bag and all clubs therein leaning forwards crumples and shortens the front portion of the bag body 7. Accordingly, a front post mounted on the front of the pivoting base 8 is inappropriate. Hence, the major support of the overall weight of the golf bag relies on the rear post, but this causes the rear post thick and heavy and the golf bag not stable upon standing.

SUMMARY OF THE INVENTION

The objective of the present invention is to provide a golf bag that can be stood obliquely in stable and has a simplified cord linking design.

To achieve the foregoing objective, the golf bag has a bag body, a bottom frame, a top frame, two legs, multiple posts and a cord.

The bag body is barrel-like and has a top opening and a bottom opening.

The bottom frame is mounted on the bottom opening of the bag body and has a cover and a bottom cuff.

The cover has a top, a top opening, a cover bottom, a cover sidewall, a chamber and a stopper.

The top opening is formed through the top of the cover. The cover bottom is opposite to the top opening and has a front portion. The cover sidewall is formed on and protrudes upwardly from a perimeter of the cover bottom. The chamber is defined by the cover sidewall and communicates with the top opening of the cover. The stopper is formed on and protrudes upwardly from the front portion of the cover bottom.

The bottom cuff is received in chamber of the cover and has a front portion, a cuff bottom, a cuff sidewall, two pivot elbows, a lever holder, a lever and multiple bottom post holders. The cuff bottom has a bevel surface formed on the front portion of the cuff bottom. The cuff sidewall is formed on and protrudes upwardly from a perimeter of the cuff bottom. The two pivot elbows are oppositely and pivotally mounted on an inside of the cover sidewall and a periphery of the cuff sidewall, and abut the front portion of the cover bottom. The lever holder is hollow, formed on an inside of the cuff sidewall to align with the stopper, and has a through hole formed through a top of the lever holder. The lever is received and pivotally mounted in the lever holder. The bottom post holders are tubular and mounted on the cuff bottom.

The top frame is mounted on the top opening of the bag body and has a top sidewall, a divider, multiple top post holders, a cord guide and two leg holders. The top sidewall has an inner surface. The divider is attached to the inner surface of the top sidewall to divide a space inside the top sidewall into multiple sub spaces. The top post holders are formed on the inner surface of the top sidewall to correspond to the bottom post holders. The cord guide is mounted on the top sidewall and the bag body and has a branching channel formed on the cord guide. The two leg holders are pivotally mounted on a periphery of the top sidewall, penetrate through the top sidewall to abut against the cord guide.

The two legs are respectively connected to the leg holders.

Each of the posts has two ends respectively mounted in one of the top post holders and a corresponding one of the bottom post holders.

The cord has a first end and a second end. The first end is tied to the lever of the bottom cuff. The second end has two branches penetrating through the lever holder and the branching channel of the cord guide and respectively tied to the leg holders.

When the golf bag is tilted, the bevel surface rests on the cover, the cord is pulled to expand the two leg holders and the two legs to stand on the ground. As the cover stay fully lying on the ground when the bottom cuff tilts, the golf bag of the present invention can stably stand and requires a simplified cord linking design.

DETAILED DESCRIPTION OF THE INVENTION

Figure 1:
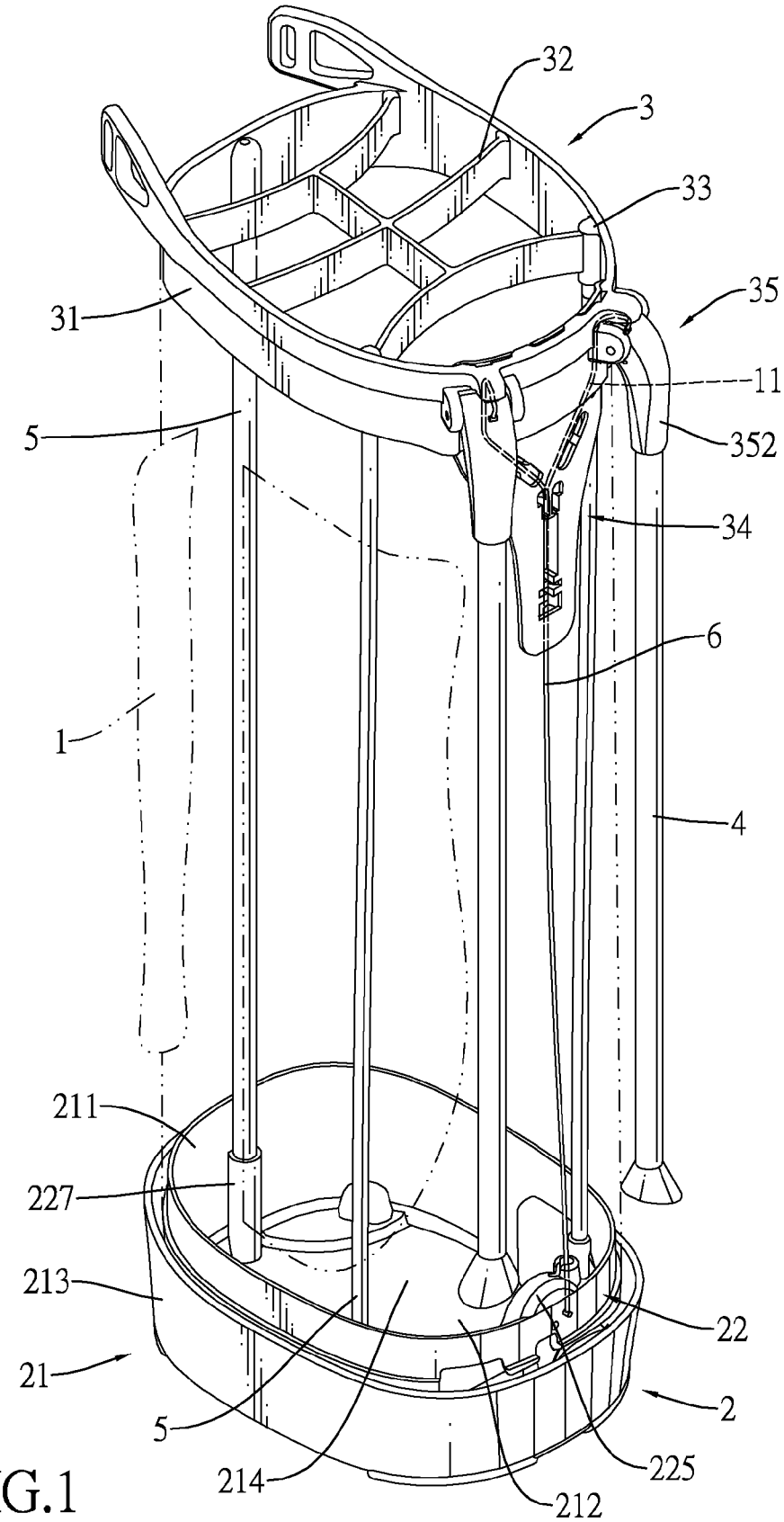
FIG. 1 is a perspective view of a golf bag in accordance with the present invention.

With reference to FIG. 1, a golf bag in accordance with the present invention has a bag body 1, a bottom frame 2, a top frame 3, two legs 4, multiple posts 5 and a cord 6.

Figure 2:
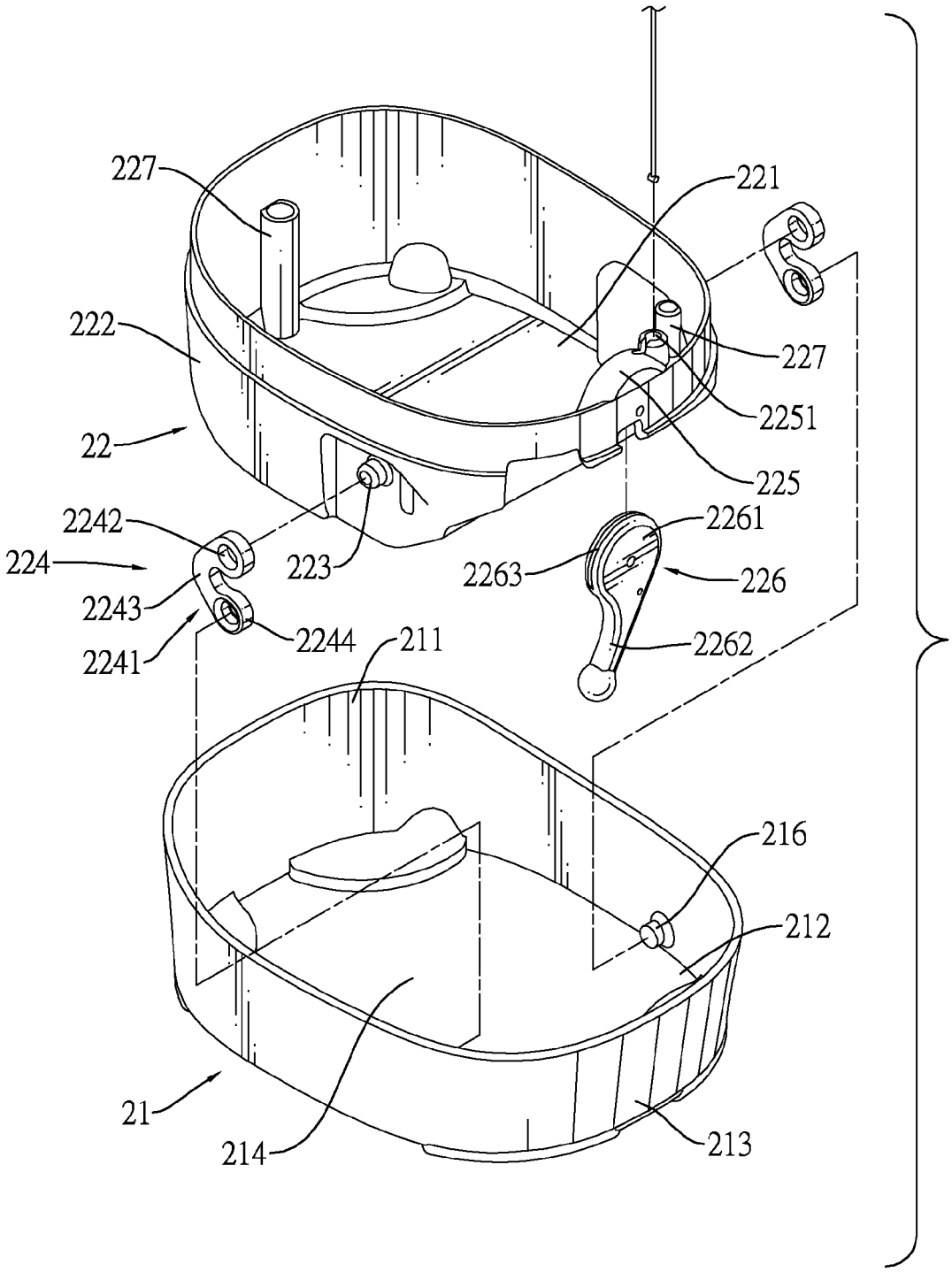
FIG. 2 is an exploded perspective view of a bottom frame of the golf bag in FIG. 1.
Figure 4:
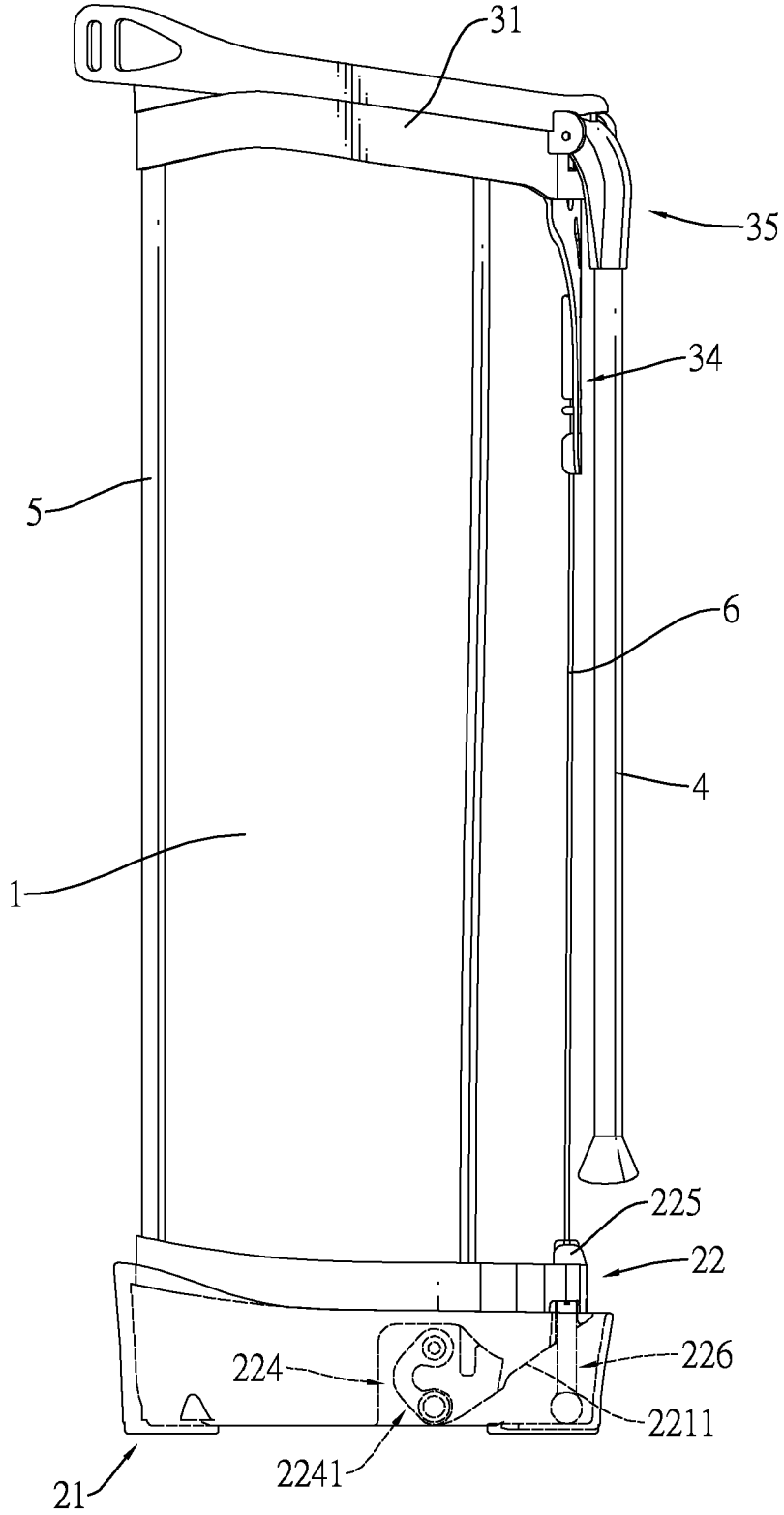
FIG. 4 is a side view of the golf bag in FIG. 1.
Figure 5:
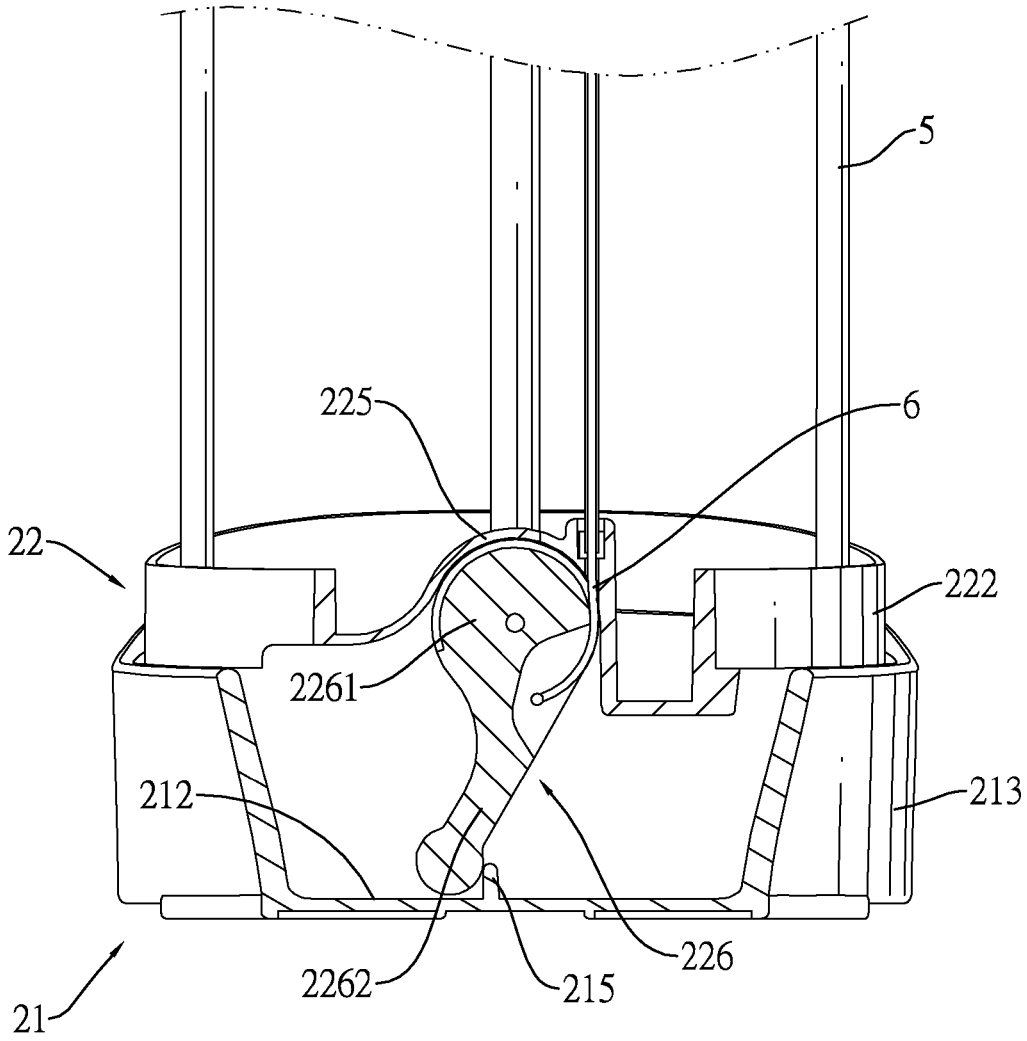
FIG. 5 is an enlarged side view in partial section of the bottom frame of the golf bag in FIG. 1.

With reference to FIGS. 2, 4 and 5, the bag body 1 is barrel-like and has a top opening and a bottom opening. The bottom frame 2 is mounted on the bottom opening of the bag body 1 and has a cover 21 and a bottom cuff 22. The cover 21 has a top, a top opening 211, a cover bottom 212, a cover sidewall 213, a chamber 214, a stopper 215 and two first pivot pins 216. The top opening 211 is formed through the top of the cover 21. The cover bottom 212 is opposite to the top opening 211 and has a front portion. The cover sidewall 213 is formed on and protrudes upwardly from a perimeter of the cover bottom 212. The chamber 214 is defined by the cover sidewall 213 and communicates with the top opening 211. The stopper 215 is formed on and protrudes upwardly from the front portion of the cover bottom 212. The two first pivot pins 216 are oppositely mounted on an inside of the cover sidewall 213 and is adjacent to the front portion of the cover bottom 212.

The bottom cuff 22 is received in chamber 214 of the cover 21 and has a cuff bottom 221, a cuff sidewall 222, two second pivot pins 223, two pivot elbows 224, a lever holder 225, a lever 226 and multiple bottom post holders 227. The cuff bottom 221 has a front portion and a bevel surface 2211. The bevel surface 2211 is formed on the front portion of the cuff bottom 221. The cuff sidewall 222 is formed on and protrudes upwardly from a perimeter of the cuff bottom 221. The two second pivot pins 223 are oppositely mounted on a periphery of the cuff sidewall 222 and respectively correspond to the two first pivot pins 216. The two pivot elbows 224 are V-shaped and has two arms 2241 and two holes 2242. Each of the two arms 2241 has an elbow end 2243 and a free end 2244. The elbow ends 2243 of the two arms 2241 are connected with each other. The hole 2242 is formed through the free end 2244 of the arm 2241. The holes 2242 of each pivot elbow 224 are mounted rotatably around the corresponding first pivot pin 216 and second pivot pin 223, and the free ends 2244 of the two pivot elbows 224 face the front portion of the cuff bottom 221. The lever holder 225 is hollow, is dome-shaped, is formed on an inside of the cuff sidewall 221, aligns with the stopper 215 and has a through hole 2251 formed through a top of the lever holder 225. The lever 226 has a disk portion 2261 and an elongated portion 2262 integrally formed with the disk portion 2261. The disk portion 2261 of the lever 226 is received in the lever holder 225 and pivotally mounted on an inner wall of the lever holder 225, and has a groove 2263 partially formed in a perimeter of the disk portion 2261. The elongated portion 2262 abuts against the cover bottom 212 of the cover 21 and one side of the stopper 215. The multiple bottom post holders 227 are tubular and are mounted on and protrude from the cuff bottom 221.

Figure 3:
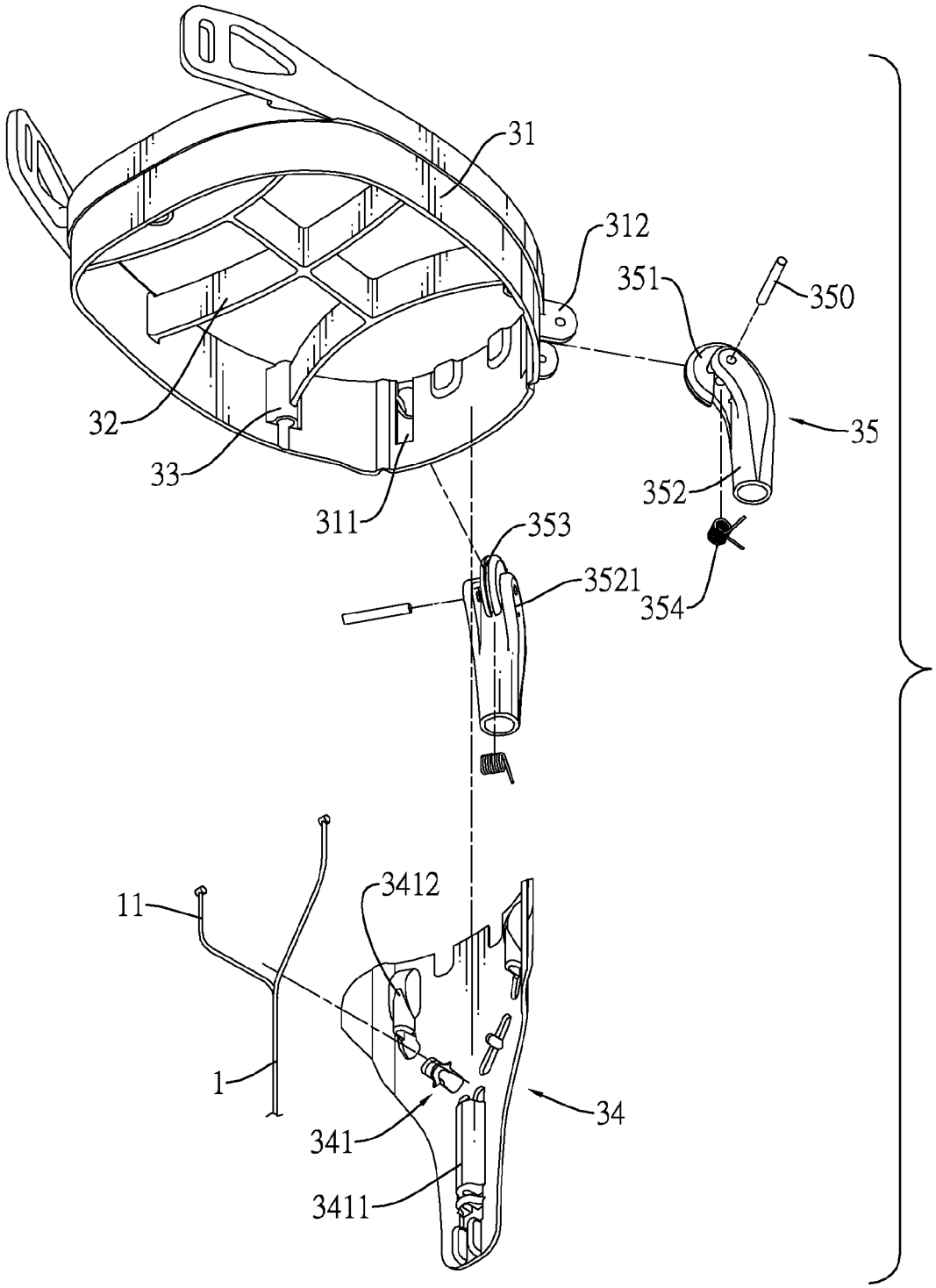
FIG. 3 is an exploded perspective view of a top frame of the golf bag in FIG. 1.

With reference to FIG. 3, the top frame 3 is mounted on the top opening of the bag body 1 and has a top sidewall 31, a divider 32, multiple top post holders 33, a cord guide 34 and two leg holders 35.

The top sidewall 31 has two slots 311 and two seats 312. The slots 311 are formed through the top sidewall 31 and corresponding to the lever holder 225 of the bottom cuff 22 respectively. Each of the seats has two walls formed beside the corresponding slots 311. The divider 33 has a mesh form and is attached to an inner surface of the top sidewall 31 to divide a space inside the top sidewall 31 into multiple sub spaces. The top post holders 33 are formed on the inner surface of the top sidewall 31 and correspond respectively to the bottom post holders 227. The cord guide 34 has a shape in reverse isosceles triangle, is mounted on the top sidewall 31 and the bag body 1, and has a Y-shaped branching channel 341. The branching channel 341 is formed in a back of the cord guide 34 and has a longitudinal portion 3411 and two branch portions 3412. The two branch portions 3412 are V-shaped and connected with the longitudinal portion 3411. The branch portions 3412 of the cord guide 34 are respectively aligned with the slots 311 on the top sidewall 31. The two leg holders 35 are pivotally mounted on a periphery of the top sidewall 31. Each of the two leg holders 35 has a pivot shaft 350, a cord receiving portion 351, a leg holding portion 352 and a torsion spring 354. The pivot shaft 350 is pivotally mounted through the walls of the corresponding seat 312. The cord receiving portion 351 is semicircular, has a groove 353 formed in an circular edge of the cord receiving portion 351, is mounted through one of the slots 311 on the top sidewall 31 and is mounted in a corresponding branch portion 3412 of the branching channel 341. The leg holding portion 352 is tubular and has a closed end and an open end. The closed end has two wings 3521 formed on the closed end and the cord receiving portion 351 is mounted between the two wings 3521. The torsion spring 354 is mounted around the corresponding pivot shaft 350.

Each of the two legs 4 is mounted in the open end of the leg holding portion 352 of one of the leg holders 35.

Each of the multiple posts 5 has two ends respectively mounted in one of the top post holders 33 and a corresponding one of the bottom post holders 227. In the present embodiment, three posts 5 are implemented, and one in the back and two in the front of the bag body 1.

The cord 6 may be a fiber cord or a metal cable and has a first end and a second end. The second end of the cord 6 has two branches 11. The first end of the cord 6 is tied to the lever 226 and received in the groove 2263 of the lever 226. The second end penetrates through the through hole 2251 of the lever holder 225. The second end further penetrates through the longitudinal portion 3411 and the two branches are respectively mounted through the two branch portions 3412. After being mounted through the two branch portions 3412 of the branching channel 341, the two branches 11 of the cord 6 are respectively received and tied in the grooves 353 of the cord receiving portions 351 of the leg holders 35.

Figure 6:
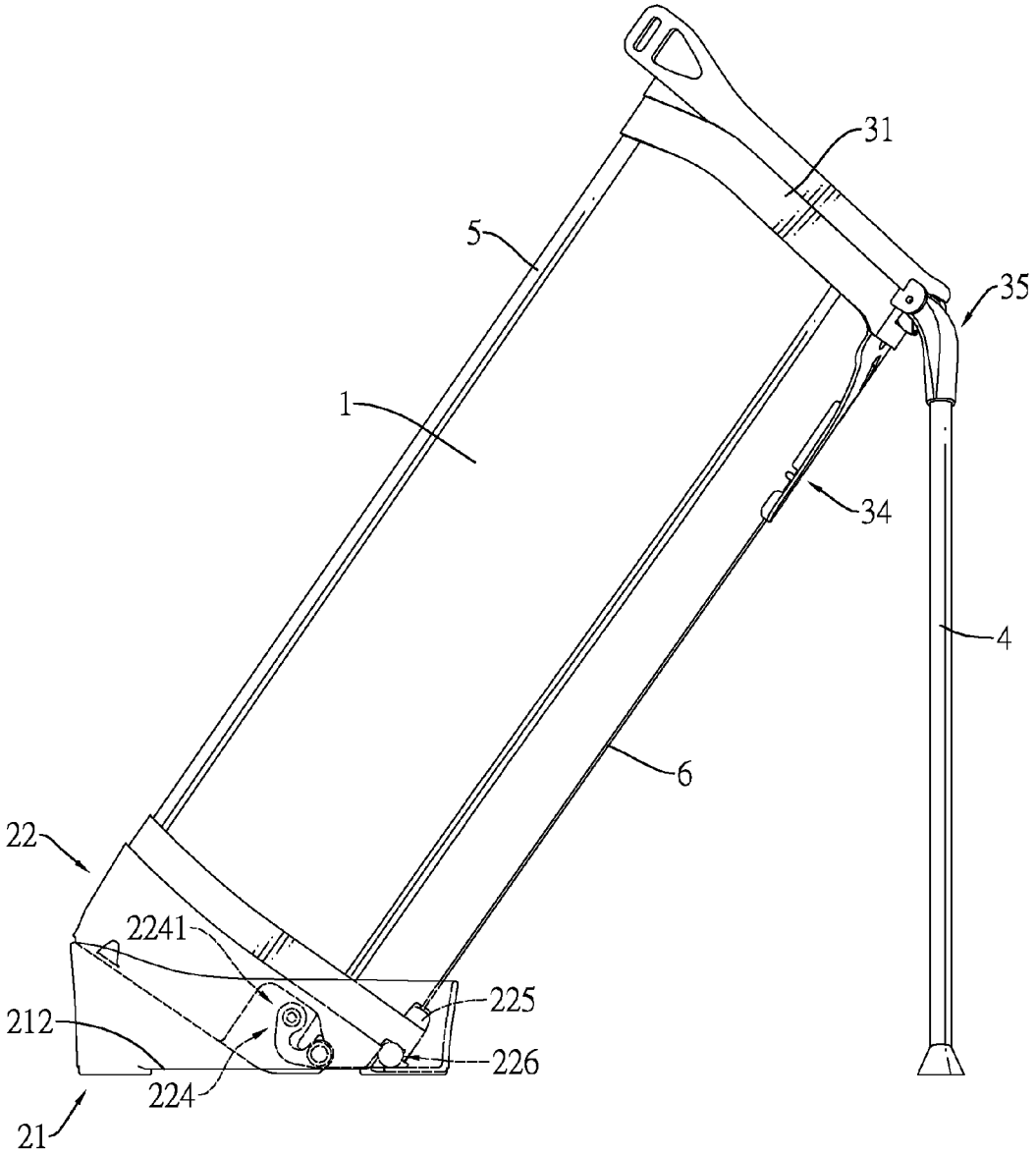
FIG. 6 is an operational side view of the golf bag in FIG. 1 showing the golf bag in an obliquely laying condition.
Figure 7:
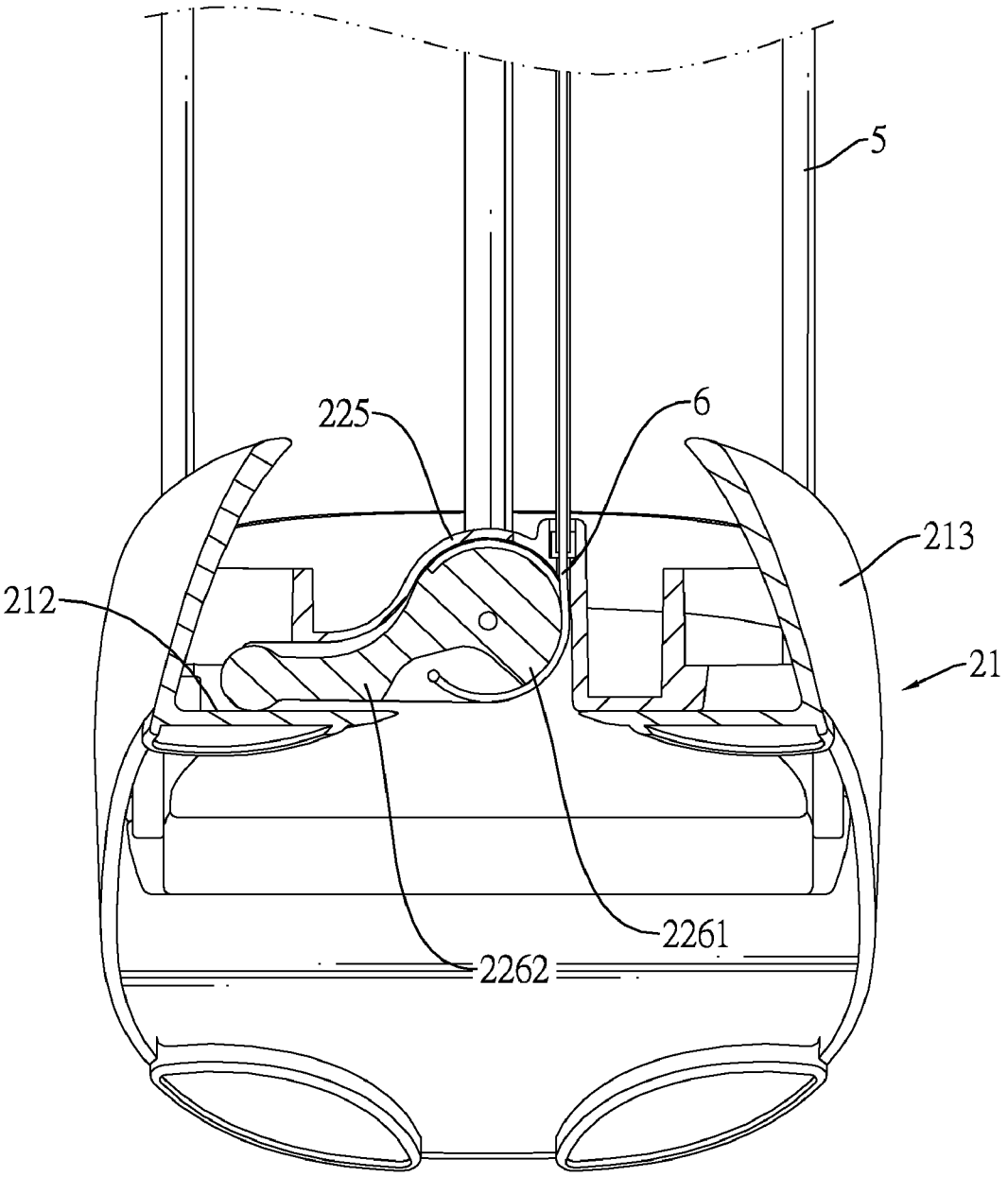
FIG. 7 is an enlarged operational front view in partial section of the bottom frame of the golf bag in FIG. 6.
Figure 8:
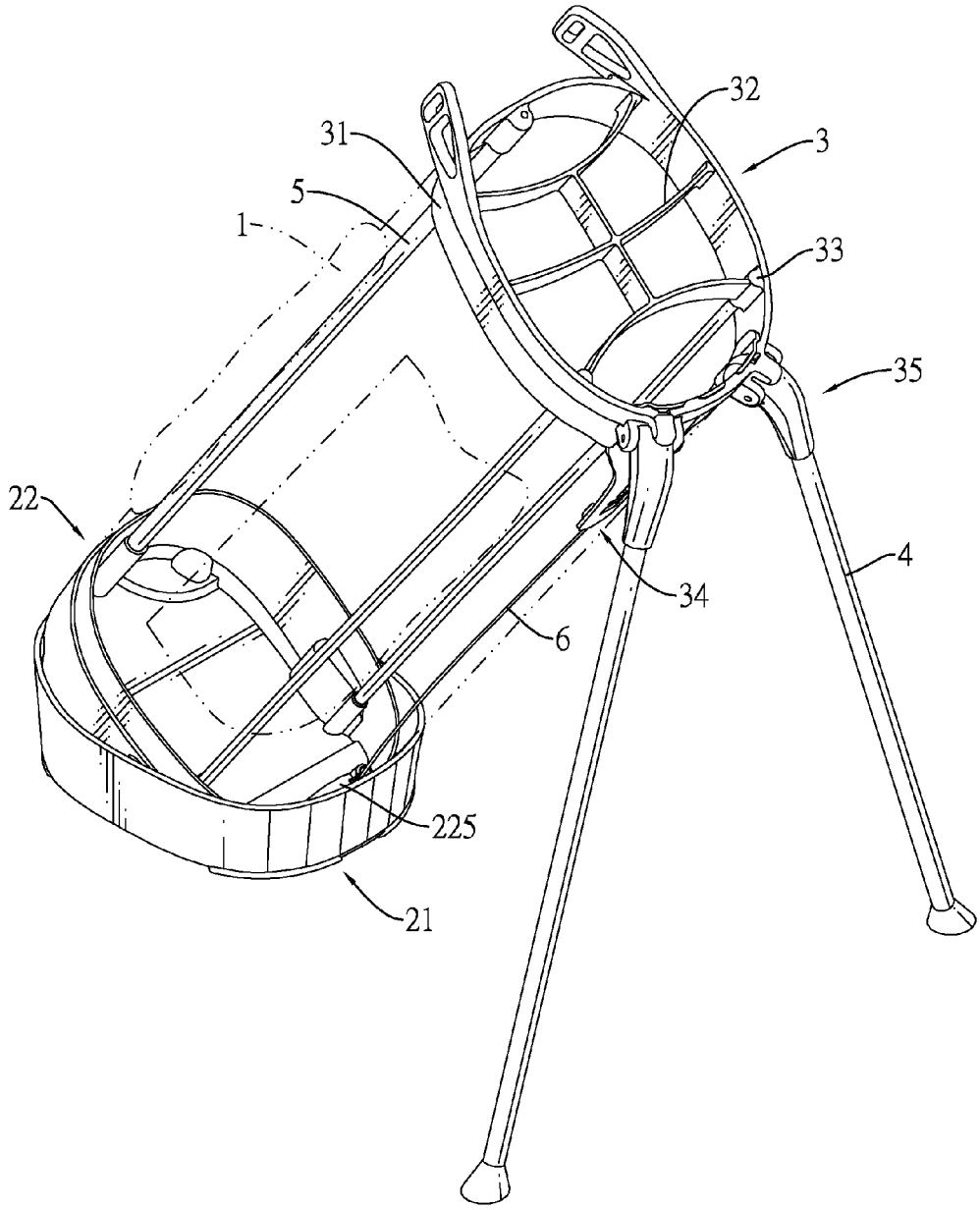
FIG. 8 is an operational perspective view of the golf bag in FIG. 6 showing the golf bag in the obliquely laying condition.
Figure 9:
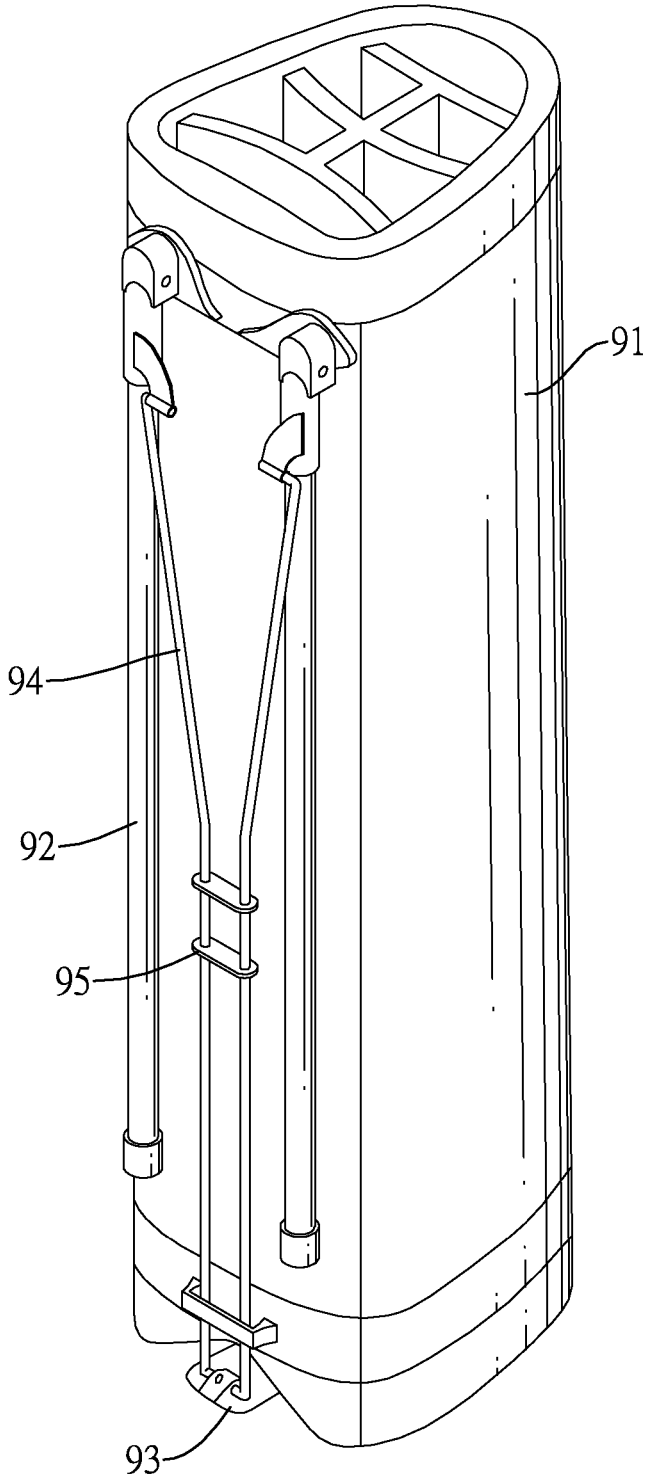
FIG.9 PRIOR ART
FIG. 9 is a perspective view of a conventional golf bag.
Figure 10:
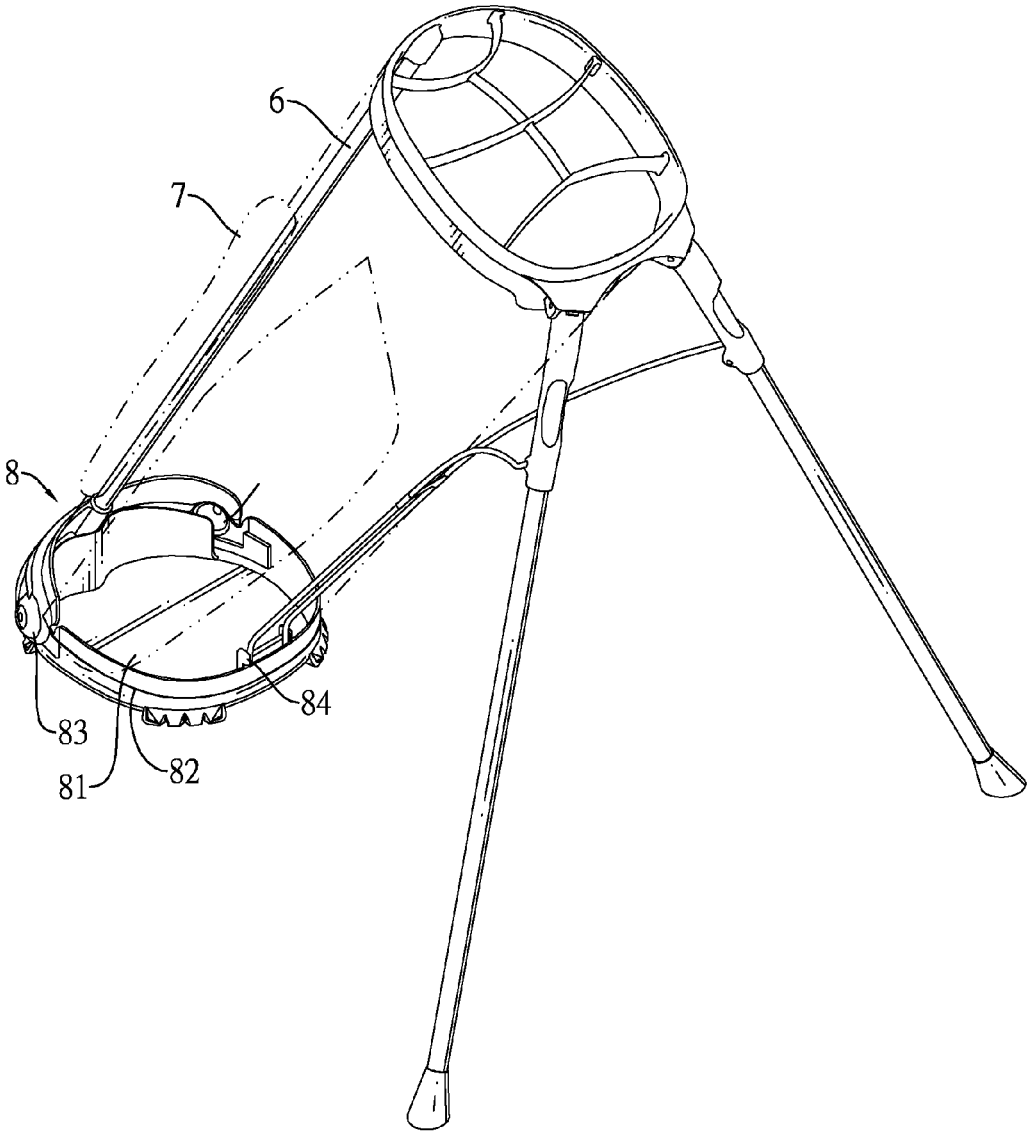
FIG.10 PRIOR ART
FIG. 10 is a perspective view of another conventional golf bag.

With reference to FIGS. 4 and 5, when the golf bag stands upright, the disk portion 2261 of the lever 226 is received in the lever holder 225 and the elongated portion 2262 of the lever 226 abuts against the cover bottom 212 of the cover 21 and the stopper 215. The free ends 2244 of two arms 2241 of each of the two pivot elbows 224 all directly face the front portion of the cover 21. Two legs 4 are folded and attached to the bag body 1. With reference to FIGS. 6 and 7, when the golf bag is leaned forwards, the front portion of the bottom cuff 22 tilts down and the bevel surface 2211 rests on the cover bottom 212 of the cover 21. The elongated portion 2262 of the lever 226 is pushed against by the cover bottom 212 of the cover 21 to pivot the disk portion 2261 relative to the lever holder 225 until the lever 226 lie on the cover bottom 212 and is blocked by a bottom edge of the cuff sidewall 221. When the lever 226 lies on the cover bottom 212, the cord 6 tied inside the groove 2263 of the disk portion 2261 is pulled downwardly. The two branches 11 of the cord 6 respectively received in the grooves 353 of the cord receiving portions 351 of the leg holders 35 are also moved downward to pivot the two leg holding portions 352 forward. Accordingly, the two leg holders 35 with the two legs 4 are expanded for obliquely standing on the ground as shown in FIG. 8.

When the golf bag of the present invention is tilted, the cover 21 is kept to lie flatly on the ground. With the two legs 4 and a full contact of the cover bottom 212 on the ground, the golf bag can be held on the ground stably. With the cord 6 being connected between the lever 226 of the bottom cuff 22 and the cord guide 34 of the top frame 3, a passage defined in the divider 32 for the cord passing therethrough is unnecessary. The structure of the golf bag and the manufacturing and assembling processes for the same can be simplified. Whenever the golf bag is tilted, the full contact of the cover on the ground prevents the front portion of the bag body 1 from being crumpled and shortened. Accordingly, multiple posts can be mounted in the front and back of the bag body to evenly share the weight of the golf bag and the clubs therein, and the posts can be lighter and thinner without causing the golf bag unstable upon standing.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A golf bag comprising:

a bag body being barrel-like and having a top opening and a bottom opening;

a bottom frame mounted on the bottom opening of the bag body and having:

a cover having:

a top;

a top opening formed through the top of the cover;

a cover bottom opposite to the top opening and having a front portion, a cover sidewall formed on and protruding upwardly from a perimeter of the cover bottom;

a chamber defined by the cover sidewall and communicating with the top opening of the cover; and a stopper formed on and protruding upwardly from the front portion of the cover bottom;

a bottom cuff received in chamber of the cover and having:

a front portion;

a cuff bottom having a bevel surface formed on the front portion of the cuff bottom;

a cuff sidewall formed on and protruding upwardly from a perimeter of the cuff bottom;

two pivot elbows oppositely and pivotally mounted on an inside of the cover sidewall and a periphery of the cuff sidewall, and abutting the front portion of the cover bottom;

a lever holder being hollow, formed on an inside of the cuff sidewall to align with the stopper, and having a through hole formed through a top of the lever holder; and a lever received and pivotally mounted in the lever holder;

a top frame mounted on the top opening of the bag body;

multiple post mounted between the bottom cuff and the top frame;

two legs connected to the top frame; and a cord connected between the lever of the bottom cuff and the two legs.

2. The golf bag as claimed in claim 1, wherein the bottom cuff further has multiple bottom post holders being tubular and mounted on the cuff bottom;

the top frame further has:

a top sidewall having an inner surface;

a divider attached to the inner surface of the top sidewall to divide a space inside the top sidewall into multiple sub spaces;

multiple top post holders formed on the inner surface of the top sidewall to correspond to the bottom post holders;

a cord guide mounted on the top sidewall and the bag body and having a branching channel formed on the cord guide; and two leg holders pivotally mounted on a periphery of the top sidewall, penetrating through the top sidewall to abut against the cord guide;

the two legs are respectively connected to the leg holders;

each of the posts has two ends respectively mounted in one of the top post holders and a corresponding one of the bottom post holders; and the cord has:

a first end tied to the lever of the bottom cuff; and a second end having two branches penetrating through the lever holder and the branching channel of the cord guide and respectively tied to the leg holders.

3. The golf bag as claimed in claim 1, wherein two first pivot pins are oppositely mounted on an inside of the cover sidewall and are adjacent to the front portion of the cover bottom, and two second pivot pins are oppositely mounted on a periphery of the cuff sidewall and respectively correspond to the two first pivot pins;

each of the two pivot elbows is V-shaped and has:

two arms, each of the two arms having:

an elbow end connected with the elbow end of the other arm; and a free end facing to the front end of the cuff bottom; and two holes, each of two holes formed through the free end of the arm to rotatably mounted around corresponding first pivot pin and second pivot pin.

4. The golf bag as claimed in claim 2, wherein two first pivot pins are oppositely mounted on an inside of the cover sidewall and are adjacent to the front portion of the cover bottom, and two second pivot pins are oppositely mounted on a periphery of the cuff sidewall and respectively correspond to the two first pivot pins;

each of the two pivot elbows is V-shaped and has:

two arms, each of the two arms having:

an elbow end connected with the elbow end of the other arm; and a free end facing to the front end of the cuff bottom; and two holes, each of two holes formed through the free end of the arm to rotatably mounted around corresponding first pivot pin and second pivot pin.

5. The golf bag as claimed in claim 1, wherein the lever holder is doom-shaped; and the lever has:

a disk portion received in the lever holder, pivotally mounted on an inner wall of the lever holder, and having a groove partially formed in a perimeter of the disk portion; and an elongated portion integrally formed with the disk portion, abutting against the cover bottom of the cover and one side of the stopper.

6. The golf bag as claimed in claim 2, wherein the lever holder is doom-shaped; and the lever has:

a disk portion received in the lever holder, pivotally mounted on an inner wall of the lever holder, and having a groove partially formed in a perimeter of the disk portion; and an elongated portion integrally formed with the disk portion, abutting against the cover bottom of the cover and one side of the stopper.

7. The golf bag as claimed in claim 3, wherein the lever holder is doom-shaped; and the lever has:

a disk portion received in the lever holder, pivotally mounted on an inner wall of the lever holder, and having a groove partially formed in a perimeter of the disk portion; and an elongated portion integrally formed with the disk portion, abutting against the cover bottom of the cover and one side of the stopper.

8. The golf bag as claimed in claim 4, wherein the lever holder is doom-shaped; and the lever has:

a disk portion received in the lever holder, pivotally mounted on an inner wall of the lever holder, and having a groove partially formed in a perimeter of the disk portion; and an elongated portion integrally formed with the disk portion, abutting against the cover bottom of the cover and one side of the stopper.

9. The golf bag as claimed in claim 1, wherein the top sidewall has:

two slots formed through the top sidewall and corresponding to the lever holder of the bottom cuff; and two seats, each having two walls formed beside the corresponding slots;

the cord guide has a shape in a reverse isosceles triangle;

the branching channel is Y-shaped and formed on a back of the cord guide and has:

a longitudinal portion; and two branch portions being V-shaped and connected with the longitudinal portion; and the two leg holders are pivotally mounted on a periphery of the top sidewall, and each of the two leg holders has:

a pivot shaft pivotally mounted through the walls of the corresponding seat;

a cord receiving portion being semicircular, having a groove formed in an circular edge of the cord receiving portion, mounted through one of the slots on the top sidewall and mounted in a corresponding branch portion of the branching channel; and a leg holding portion being tubular and having:

a closed end having two wings formed on the closing end and formed beside the cord receiving portion; and an open end;

a torsion spring mounted around the corresponding pivot shaft; and each of the two legs is mounted in the open end of the leg holding portion of one of the leg holders.

10. The golf bag as claimed in claim 2, wherein the top sidewall has:

two slots formed through the top sidewall and corresponding to the lever holder of the bottom cuff; and two seats, each having two walls formed beside the corresponding slots;

the cord guide has a shape in a reverse isosceles triangle;

the branching channel is Y-shaped and formed on a back of the cord guide and has:

a longitudinal portion; and two branch portions being V-shaped and connected with the longitudinal portion; and the two leg holders are pivotally mounted on a periphery of the top sidewall, and each of the two leg holders has:

a pivot shaft pivotally mounted through the walls of the corresponding seat;

a cord receiving portion being semicircular, having a groove formed in an circular edge of the cord receiving portion, mounted through one of the slots on the top sidewall and mounted in a corresponding branch portion of the branching channel; and a leg holding portion being tubular and having:

a closed end having two wings formed on the closing end and formed beside the cord receiving portion; and an open end;

a torsion spring mounted around the corresponding pivot shaft; and each of the two legs is mounted in the open end of the leg holding portion of one of the leg holders.

11. The golf bag as claimed in claim 3, wherein the top sidewall has:

two slots formed through the top sidewall and corresponding to the lever holder of the bottom cuff; and two seats, each having two walls formed beside the corresponding slots;

the cord guide has a shape in a reverse isosceles triangle;

the branching channel is Y-shaped and formed on a back of the cord guide and has:

a longitudinal portion; and two branch portions being V-shaped and connected with the longitudinal portion; and the two leg holders are pivotally mounted on a periphery of the top sidewall, and each of the two leg holders has:

a pivot shaft pivotally mounted through the walls of the corresponding seat;

a cord receiving portion being semicircular, having a groove formed in an circular edge of the cord receiving portion, mounted through one of the slots on the top sidewall and mounted in a corresponding branch portion of the branching channel; and a leg holding portion being tubular and having:
a closed end having two wings formed on the closing end and formed beside the cord receiving portion; and
an open end;
a torsion spring mounted around the corresponding pivot shaft; and
each of the two legs is mounted in the open end of the leg holding portion of one of the leg holders.

12. The golf bag as claimed in claim 4, wherein
the top sidewall has:
two slots formed through the top sidewall and corresponding to the lever holder of the bottom cuff; and
two seats, each having two walls formed beside the corresponding slots;
the cord guide has a shape in a reverse isosceles triangle;
the branching channel is Y-shaped and formed on a back of the cord guide and has:
a longitudinal portion; and
two branch portions being V-shaped and connected with the longitudinal portion; and
the two leg holders are pivotally mounted on a periphery of the top sidewall, and each of the two leg holders has:
a pivot shaft pivotally mounted through the walls of the corresponding seat;
a cord receiving portion being semicircular, having a groove formed in an circular edge of the cord receiving portion, mounted through one of the slots on the top sidewall and mounted in a corresponding branch portion of the branching channel; and
a leg holding portion being tubular and having:
a closed end having two wings formed on the closing end and formed beside the cord receiving portion; and
an open end;
a torsion spring mounted around the corresponding pivot shaft; and
each of the two legs is mounted in the open end of the leg holding portion of one of the leg holders.

13. The golf bag as claimed in claim 5, wherein
the top sidewall has:
two slots formed through the top sidewall and corresponding to the lever holder of the bottom cuff; and
two seats, each having two walls formed beside the corresponding slots;
the cord guide has a shape in a reverse isosceles triangle;
the branching channel is Y-shaped and formed on a back of the cord guide and has:
a longitudinal portion; and
two branch portions being V-shaped and connected with the longitudinal portion; and
the two leg holders are pivotally mounted on a periphery of the top sidewall, and each of the two leg holders has:
a pivot shaft pivotally mounted through the walls of the corresponding seat;
a cord receiving portion being semicircular, having a groove formed in an circular edge of the cord receiving portion, mounted through one of the slots on the top sidewall and mounted in a corresponding branch portion of the branching channel; and
a leg holding portion being tubular and having:
a closed end having two wings formed on the closing end and formed beside the cord receiving portion; and
an open end;
a torsion spring mounted around the corresponding pivot shaft; and
each of the two legs is mounted in the open end of the leg holding portion of one of the leg holders.

14. The golf bag as claimed in claim 6, wherein
the top sidewall has:
two slots formed through the top sidewall and corresponding to the lever holder of the bottom cuff; and
two seats, each having two walls formed beside the corresponding slots;
the cord guide has a shape in a reverse isosceles triangle;
the branching channel is Y-shaped and formed on a back of the cord guide and has:
a longitudinal portion; and
two branch portions being V-shaped and connected with the longitudinal portion; and
the two leg holders are pivotally mounted on a periphery of the top sidewall, and each of the two leg holders has:
a pivot shaft pivotally mounted through the walls of the corresponding seat;
a cord receiving portion being semicircular, having a groove formed in an circular edge of the cord receiving portion, mounted through one of the slots on the top sidewall and mounted in a corresponding branch portion of the branching channel; and
a leg holding portion being tubular and having:
a closed end having two wings formed on the closing end and formed beside the cord receiving portion; and
an open end;
a torsion spring mounted around the corresponding pivot shaft; and
each of the two legs is mounted in the open end of the leg holding portion of one of the leg holders.

15. The golf bag as claimed in claim 7, wherein
the top sidewall has:
two slots formed through the top sidewall and corresponding to the lever holder of the bottom cuff; and
two seats, each having two walls formed beside the corresponding slots;
the cord guide has a shape in a reverse isosceles triangle;
the branching channel is Y-shaped and formed on a back of the cord guide and has:
a longitudinal portion; and
two branch portions being V-shaped and connected with the longitudinal portion; and
the two leg holders are pivotally mounted on a periphery of the top sidewall, and each of the two leg holders has:
a pivot shaft pivotally mounted through the walls of the corresponding seat;
a cord receiving portion being semicircular, having a groove formed in an circular edge of the cord receiving portion, mounted through one of the slots on the top sidewall and mounted in a corresponding branch portion of the branching channel; and
a leg holding portion being tubular and having:
a closed end having two wings formed on the closing end and formed beside the cord receiving portion; and
an open end;
a torsion spring mounted around the corresponding pivot shaft; and
each of the two legs is mounted in the open end of the leg holding portion of one of the leg holders.

16. The golf bag as claimed in claim 8, wherein
the top sidewall has:
two slots formed through the top sidewall and corresponding to the lever holder of the bottom cuff; and two seats, each having two walls formed beside the corresponding slots;

the cord guide has a shape in a reverse isosceles triangle;

the branching channel is Y-shaped and formed on a back of the cord guide and has:

a longitudinal portion; and two branch portions being V-shaped and connected with the longitudinal portion; and the two leg holders are pivotally mounted on a periphery of the top sidewall, and each of the two leg holders has:

a pivot shaft pivotally mounted through the walls of the corresponding seat;

a cord receiving portion being semicircular, having a groove formed in an circular edge of the cord receiving portion, mounted through one of the slots on the top sidewall and mounted in a corresponding branch portion of the branching channel; and a leg holding portion being tubular and having:

a closed end having two wings formed on the closing end and formed beside the cord receiving portion; and an open end;

a torsion spring mounted around the corresponding pivot shaft; and each of the two legs is mounted in the open end of the leg holding portion of one of the leg holders.

17. The golf bag as claimed in claim 9, wherein the first end of the cord is received in the groove of the lever, the second end penetrates through the through hole of the lever holder and the longitudinal portion of the branching channel and the two branches are respectively mounted through the two branch portions of the branching channel and are respectively received and tied in the grooves of the cord receiving portions of the leg holders.

18. The golf bag as claimed in claim 11, wherein the first end of the cord is received in the groove of the lever, the second end penetrates through the through hole of the lever holder and the longitudinal portion of the branching channel and the two branches are respectively mounted through the two branch portions of the branching channel and are respectively received and tied in the grooves of the cord receiving portions of the leg holders.

19. The golf bag as claimed in claim 13, wherein the first end of the cord is received in the groove of the lever, the second end penetrates through the through hole of the lever holder and the longitudinal portion of the branching channel and the two branches are respectively mounted through the two branch portions of the branching channel and are respectively received and tied in the grooves of the cord receiving portions of the leg holders.

20. The golf bag as claimed in claim 16, wherein the first end of the cord is received in the groove of the lever, the second end penetrates through the through hole of the lever holder and the longitudinal portion of the branching channel and the two branches are respectively mounted through the two branch portions of the branching channel and are respectively received and tied in the grooves of the cord receiving portions of the leg holders.

* * * * *